United States Patent [19]

Garrett et al.

[11] 4,352,477

[45] Oct. 5, 1982

[54] SUPPORT FOR HOLDING BRUSHES

[76] Inventors: Vern L. Garrett; Morine V. Garrett, both of 863 18th Ave., Sweet Home, Oreg. 97386

[21] Appl. No.: 176,765

[22] Filed: Aug. 11, 1980

[51] Int. Cl.[3] ..... A46B 17/06

[52] U.S. Cl. ..... 248/156; 15/257 R; 211/65; 248/110; 279/99

[58] Field of Search ..... 211/65; 15/257 R; 269/152, 155, 102; 134/38; 248/156, 176, 110; 279/99

[56] References Cited

U.S. PATENT DOCUMENTS

| | | | |
|---|---|---|---|
| 605,613 | 6/1898 | Richter | 269/102 |
| 1,005,985 | 10/1911 | Lebherz | 211/65 X |
| 2,965,111 | 12/1960 | Feigelman | 134/38 X |
| 3,473,770 | 10/1969 | Edgerton | 248/156 |

FOREIGN PATENT DOCUMENTS

| | | | |
|---|---|---|---|
| 5625 | of 1906 | United Kingdom | 15/257 R |

*Primary Examiner*—William R. Briggs
*Assistant Examiner*—Jerry Kearns
*Attorney, Agent, or Firm*—Blair, Brown & Kreten

[57] ABSTRACT

Disclosed herein is a support for holding brushes, rollers and the like for cleaning which includes a spike adapted to be inserted within the ground for example, a body portion extending upwardly therefrom, an orthogonally outwardly extending purchase area relative to the body, which assists driving the spike into the ground and also serves to support a portion of a paintbrush, a resilient clip disposed on the body proximate to the purchase area for retention of a paintbrush handle, and a threaded top area extending upwardly from the body which allows threaded engagement with a roller handle having complementally formed threads on the top of the body.

7 Claims, 4 Drawing Figures

SUPPORT FOR HOLDING BRUSHES

BACKGROUND OF THE INVENTION

Perhaps the least desirable aspect of painting, is the after painting chores of cleaning the equipment. Even with water based paints, the ease with which a cleanup can be effected can sometimes provide the painter with a desire to replace his brushes and rollers rather than clean them.

In an attempt to reduce the burden that normally exists in cleaning paintbrushes and the like, the following reflects the state of the art in so far as applicant is aware:

U.S. Pat. No. 2,483,265—Dalia;
U.S. Pat. No. 3,407,429—De Nardo;
U.S. Pat. No. 3,430,286—Bownes;
U.S. Pat. No. 3,467,400—MacKenzie et al.
U.S. Pat. No. 4,157,598—Talent et al.

Of these, MacKenzie et al. appears to have the greatest relevance to that which is taught in the instant application since he provides a device which has clamping jaws, an interior portion of which is suitably fashioned to engage a paintbrush, the exterior portion of which can allow the sliding reception thereon of a roller. Clearly, the gymnastics involved in allowing a roller to be slidably disposed over the MacKenzie apparatus really makes the cleaning utensil superfluous, since at that time, the person mounting the roller on the device has already contaminated his hands with paint. Furthermore, the insertion of a paint brush within the interior locking mechanism does not appear to provide a solid support especially since the cleaning action that takes place is a rotational centrifugal cleaning arrangment.

The remaining references, while showing the state of the further, appear to diverge even further from the instant application, those elements common to the prior art and the instant application are believed to be merely coincidental.

In any event, the apparatus according to the present invention provides benefits not contemplated by the prior art in that a roller or a brush can be mounted thereupon with the surety of having the paint retention surface of the brush or the roller not engage the hands. Furthermore, the apparatus according to the present invention provides a device which allows the easy insertion of a roller upon the device which is consistent with the roller structure that includes a wire support axle and handle. The device of the present invention provides a structure which allows for the easy insertion of the device into the ground or another similarly easily penetrable substance so as to allow the person cleaning the brushes or rollers to be a distance away from the brush or the roller thereby reducing the likelihood of splatter.

SUMMARY AND OBJECTIVES OF THE INVENTION

Accordingly, it is an object of this invention to provide a device which allows the cleaning of brushes and rollers and the like, which is easily set up, and once in use, reduces the amount of work required by the cleaner.

It is another object to provide a device of the character described above which does not cause the person doing the cleaning to become contaminated with the paint.

It is further object to provide a device of the character described above which is relatively inexpensive to manufacture, durable in construction, and of reasonable cost.

It is further object of this invention to provide a device of the character described above which can easily accommodate brushes, rollers and the like of various dimensions.

It is yet a further object of this invention to provide a device of the character described above which is relatively immune from the effects of the cleaning substance such as water from a garden hose, and to allow the cleaning process to proceed expeditiously.

These and other objects will be made manifest when considering the following detailed specification when taken in conjunction with the appended drawing figures wherein there is provided a support for holding paintbrushes, rollers and the like for cleaning in which a spike is provided for insertion into the ground, a body portion extending upwardly therefrom, a purchase area to assist in driving the spike into the ground and also simultaneously providing an abutment against which a paintbrush is disposed, a resilient clip for carrying a paintbrush handle, and a threaded area on the top portion of the body to allow threaded engagement of a roller handle.

DESCRIPTION OF THE PREFERRED EMBODIMENT

Figure 1:
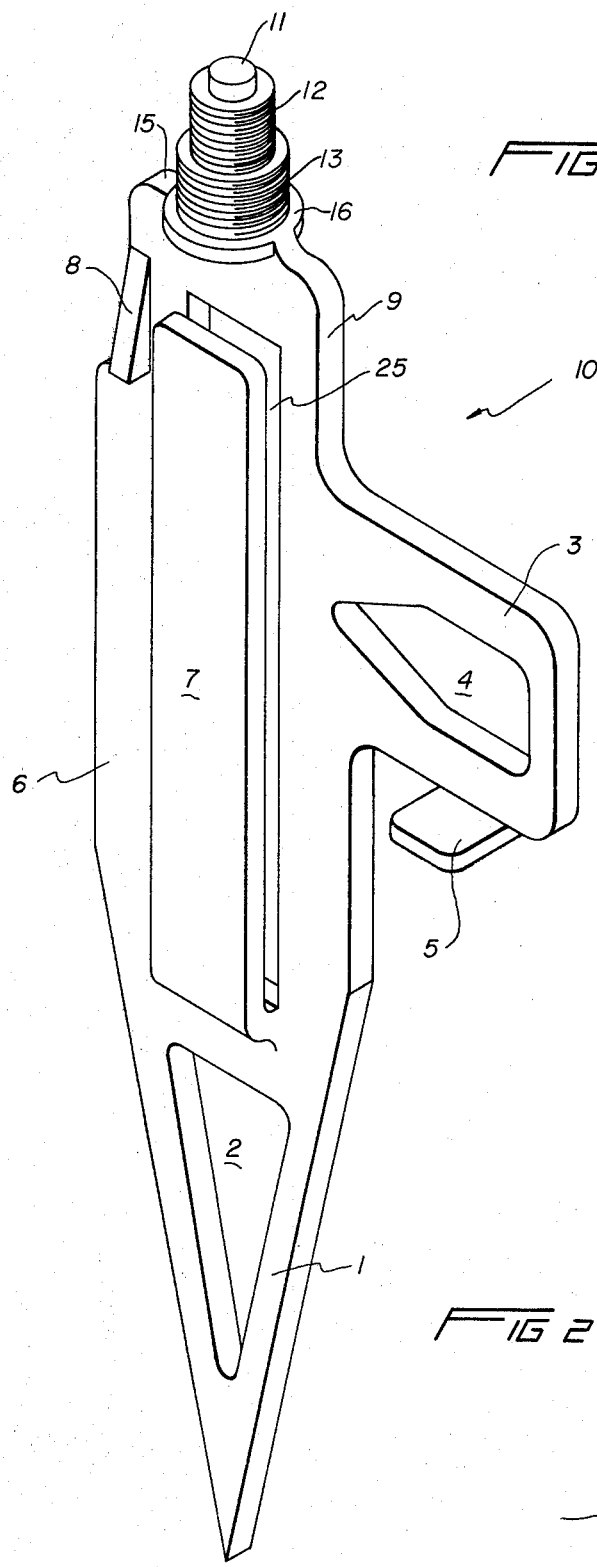
FIG. 1 is a perspective view of one form of the invention.
Figure 2:
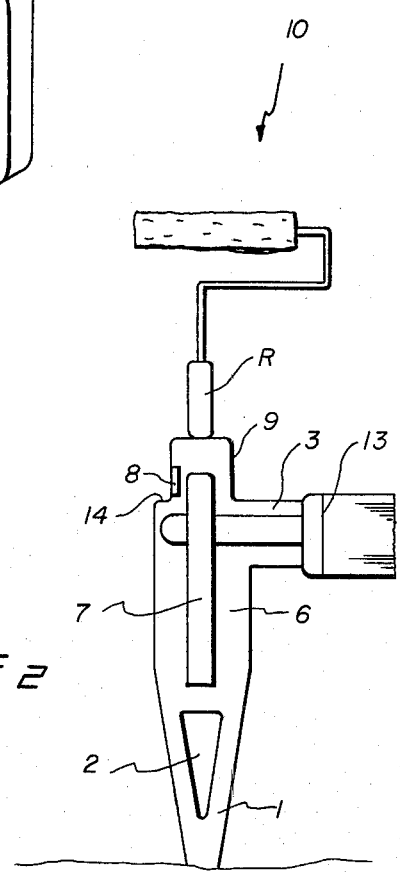
FIG. 2 is a side view thereof.

Referring to the drawings now, wherein like reference numerals refer to like parts throughout the various drawing figures, reference numeral 10 is directed to the support for holding paintbrushes, rollers and the like according to the present invention.

The support 10 is provided with spike means 1 for insertion and retention into a penetrable substance such as the ground, and as shown in FIG. 1, the spike is provided with an open area 2 which not only materially reduces the weight of the object, but also allows insertion to become an easier process. The spike is disposed below the body portion 6, and as shown, tapers to a point.

Figure 3:
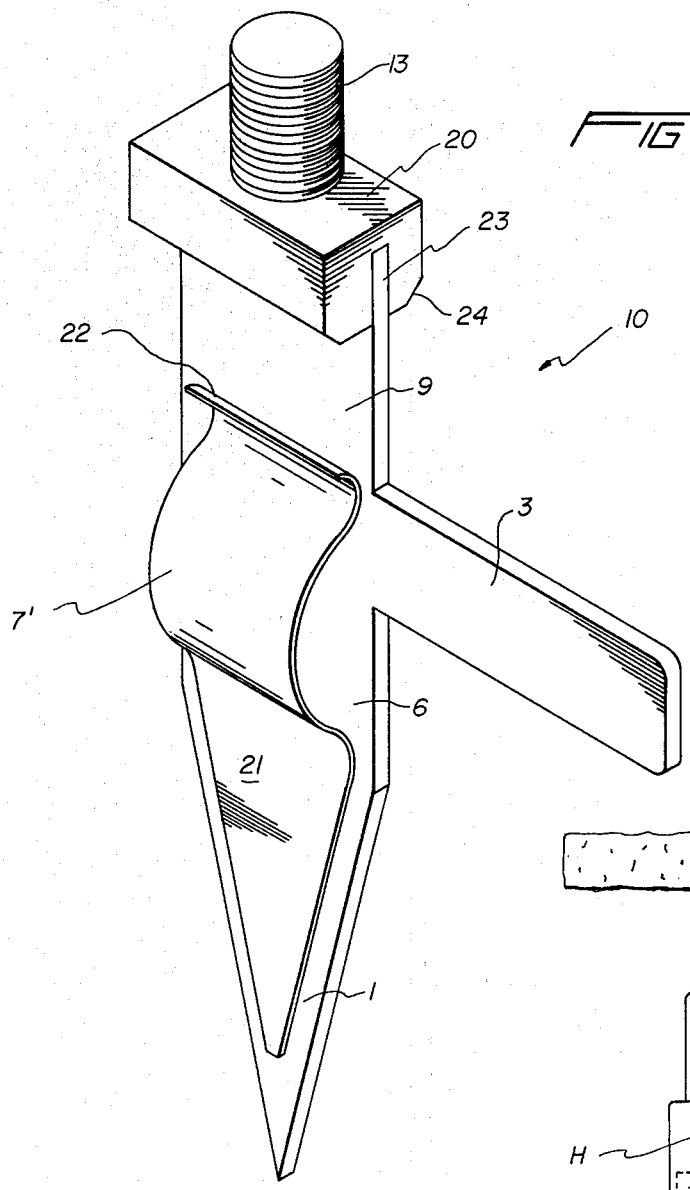
FIG. 3 is a perspective view of the second form of the invention.
Figure 4:
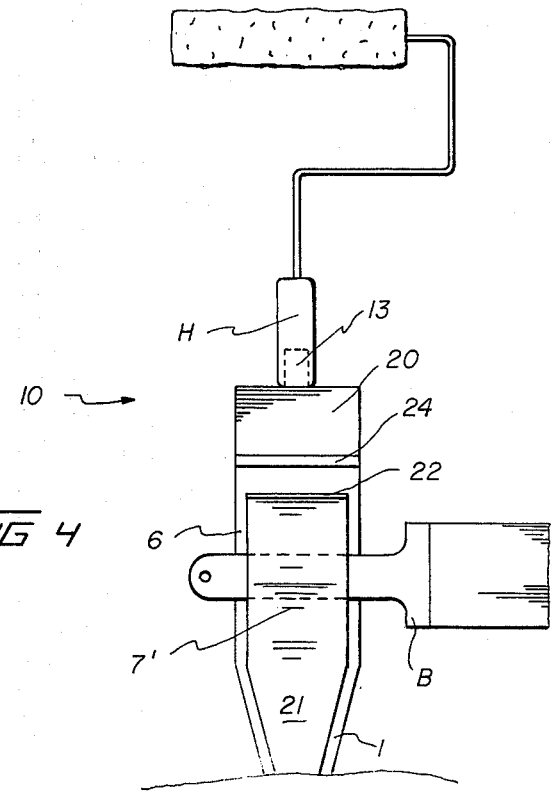
FIG. 4 is a side view thereof.

The body portion 6 is of substantially rectangular configuration, having on one face a resilient clip means which in FIG. 1 bears the legend 7, and FIG. 3, 7'.

In FIG. 1, the resilient clip means is formed by punching an open area in the main body and having an outwardly extending parallel strip 7 overlying the opening 25 in the body, wherein the strip has a memory and is formed from plastic so that it tends to be retained in the configuration show in perspective, FIG. 1.

In the second form of the invention, the resilient clip means comprises a spring element haveing a bulbous central portion 7' and an upwardly and outwardly curved top portion 22 and a tapered bottom portion 21 paralleling the spike means and affixed thereto. Preferably, in this embodiment, the bulbous central portion and upwardly and outwardly curved portion are made from spring metal and the bulbous central portion allows engagement with the handle of the paintbrush.

In order to further assist the support of the paintbrush during the cleaning process, a purchase area 3 extends orthogonally outwardly from the main body 6. The purchase area 3 has a generally rectangular configuration, and FIG. 1 shows a further open area 4 to further reduce the weight, and also provide a hand grip area for retracting the support from the ground when the cleaning operation has been completed. The bottom face of the purchase area can be provided with a stop member 5 which is perpendicular to both the body and purchase area so that the spike is assured of not being driven too deeply into the ground should the earth be extremely soft, and to support the brush.

FIG. 1 depicts a ramp 8 having a substantially wedge shaped configuration in which the sloped outer face shown in FIG. 1 provides a means for assisting and prying open the member 7 for insertion of the handle therein. However, though once the handle is disposed within the spring clip 7, rotation of the paintbrush by spraying of water thereon is resisted not only by the stop member 5, but also abutment of the handle of the paintbrush engaging the bottom edge of the ramp 8. It is to be noted that in FIG. 1, the top portion of the body is shown to have a narrowed width relative to the main body, proximate to where the ramp 8 is provided.

As shown in FIG. 1, the threaded area on the top portion of the body is provided with two stepped areas, a stepped area having threads 12 of lesser dimension than the lower threaded area 13, a stop flange 16 therebelow, and a topmost shaft 11. Clearly, the device while having these two different threaded portions, allows rollers of different handle dimension to be accommodated by this single tool, and the shaft top 11 allows for guiding and abutment within the threaded recess of the handle.

As shown in FIG. 3, while a single thread 13 is provided, a step portion similar to that shown in FIG. 1 could also be effected. In this construction however the threaded topmost portion is affixed to the body top portion 9 by means of a block 20 having a slot 23 on a bottom face thereof which overlies the topmost portion of the body 9 as by frictional engagement, adhesion, or the like. The bottom edges 24 of the block 20 are bevelled to allow an easy grasping area for retracting the support from the ground should the open areas 4 not be provided.

Having thus described the invention, it should be apparent that there has been provided a support for cleaning both paintbrushes and paint rollers of various dimensions and the like, that includes a spike for insertion and retention into penetrable substance such as the ground, a body extending upwardly therefrom, a purchase area to assist in driving a spike and allowing the brush to rest thereagainst, a resilient spring clip for carrying the brush handle disposed on the body, and a threaded area extending upwardly from the body to engage a roller handle.

Further, having thus described the invention, it should be apparent that numerous structural modifications are contemplated as being a part of this invention as set forth hereandabove and as defined hereandbelow by the claims.

What is claimed is:

1. A support for holding paint brushes, rollers and the like for cleaning, comprising in combination:

a spike means for insertion and retention in a penetrable substance, a body extending upwardly therefrom of substantially rectangular configuration and said spike means has a top portion of substantially the same width, tapering downwardly to a point, a purchase area extending outwardly from said body having a top face to assist in driving said spike means and a side face to abut against a brush in resisting water pressure, a resilent clip means for carrying a brush handle, said clip means on said body comprising an outwardly offset strip overlying said body, said strip having a memory, and a threaded area extending upwardly from said body to engage a complementally threaded roller handle, wherein a stop member is provided on a bottom edge of said purchase area.

2. The device of claim 1 wherein open areas are provided on said purchase area and spike means to assist in removal from the penetrated substance.

3. The device of claim 2 wherein said threaded area has upper and lower threaded portions, said lower portion of greater diameter to accommodate roller handles of different sizes.

4. The device of claim 3 wherein said body has a narrowed portion below said threaded area including a wedge shaped ramp engageable with a brush handle to retard rotation.

5. The device of claim 1 wherein said resilient clip means comprise a spring element having a bulbous central portion, an upwardly and outwardly curved top portion and a tapered bottom portion paralleling said spike means and affixed thereto.

6. The device of claim 5 wherein said threaded area engages said body portion by means of a block having a slit on a bottom face which overlies said body.

7. The device of claim 1 including an opening in said body proximate said clip means.

* * * * *